United States Patent [19]

Slade

[11] 3,978,300

[45] Aug. 31, 1976

[54] LOW-VOLTAGE CIRCUIT-BREAKER HAVING SMALL CONTACT SEPARATION AND SMALL GAP BETWEEN COOPERATING PARALLEL-ARRANGED ARCING-RAILS

[75] Inventor: Paul G. Slade, Pittsburgh, Pa.

[73] Assignee: Westinghouse Electric Corporation, Pittsburgh, Pa.

[22] Filed: Feb. 11, 1975

[21] Appl. No.: 533,413

[52] U.S. Cl. ..... 200/147 R; 200/144 R

[51] Int. Cl.[2] ..... H01H 33/02

[58] Field of Search ..... 200/147 R, 147 B, 144 R

[56] References Cited

UNITED STATES PATENTS

| | | | |
|---|---|---|---|
| 3,402,272 | 9/1968 | Jensen | 200/147 B |
| 3,489,872 | 1/1970 | Casey | 200/147 R |

FOREIGN PATENTS OR APPLICATIONS

| | | | |
|---|---|---|---|
| 1,249,591 | 2/1960 | France | 200/147 R |
| 1,274,727 | 8/1968 | Germany | 200/146 R |

*Primary Examiner*—Robert S. Macon

*Attorney, Agent, or Firm*—R. E. Converse, Jr.

[57] ABSTRACT

An improved low-voltage circuit-breaker, adaptable for both alternating-current and direct-current is provided having small contact separation, when opened, and a pair of adjoining arcing-rails arranged in generally-parallel relationship, and having only a small gap therebetween of the order of ¼ inch or less. Preferably, at the ends of the parallel-arranged arcing-rails are a pair of diverging arc-horns, constituting integral extensions of the parallel-arranged arcing-rails, and resulting in considerable elongation of the established arc upon its movement onto the diverging portions of the arcing-rails.

Preferably, although not necessary, a suitable spaced-plate arc-extinguishing structure is arranged in the vicinity of the diverging portions of the arcing-rails to further facilitate arc extinction, by either elongating the arc around the splitter portions of the insulating plates, if the latter are of insulating material, or causing the formation of a plurality of serially-related arc-portions between spaced conducting metallic plates, if the arc extinguisher is of the spaced-metallic-plate variety.

8 Claims, 11 Drawing Figures

LOW-VOLTAGE CIRCUIT-BREAKER HAVING SMALL CONTACT SEPARATION AND SMALL GAP BETWEEN COOPERATING PARALLEL-ARRANGED ARCING-RAILS

CROSS-REFERENCES TO RELATED APPLICATIONS

Applicant is not aware of any related patent applications pertinent to the present invention.

BRIEF SUMMARY OF THE INVENTION

In accordance with the present invention, there is provided an improved low-voltage (of the order of 1000 volts rms, or less) air-type circuit-breaker having a very small contact separation gap, when the circuit-breaker contacts are opened, and having adjoining, generally-parallel arcing-rails, also having a small gap therebetween, of the order, say, for example, ¼ inch or less, onto which the established arc is moved from the separated contacts onto the parallel-disposed arcing-rails.

Preferably, at the ends of the arcing-rails there are provided diverging integral portions causing a rapid extension of the established arc at the ends of the arcing-rails to further effect arc elongation, and an increase in arc-voltage to thereby effect arc interruption.

DESCRIPTION OF THE PREFERRED EMBODIMENTS

Over the past years, the physical dimensions of low-voltage air-type circuit-breakers (both ac and dc) have been getting smaller, but at the same time, their interrupting ability has been improving. There are a number of reasons for this:

a. Better understanding of the physical parameters involved in the current-interruption process.
b. More sophisticated engineering design.
c. Competition from other manufacturers and a desire for cost reduction.
d. It is aesthetically more pleasing to have the breakers packaged in the smallest possible unit.

The present invention relates to a new design of the low-voltage air-type circuit breaker which is more compact and has an improved current-interrupting ability. The principles involved could also be used in other gases, but generally I contemplate an air-break interrupting device. The new design is arrived at by use of recent knowledge of the effects that arcs have on current interruption, and by studies of the movement of arcs between parallel arcing-rails.

In low-voltage circuits, it is not necessary to have large contact gaps in order to withstand the typical open-circuit voltages that occur. For example, under the worst possible conditions, a gap of 0.2 inch will withstand between 5 K.V. and 17 K.V., and even at 0.04 inch, the gap will still withstand beween 2 K.V. and 5 K.V. If, after current interruption, the ionized plasma has been swept away from the small gap, the proximity of the electrodes will help to cool the gas in the gap more quickly, and hence, will enhance the dielectric recovery of the gap.

In order to move the arc away from the contact electrodes as quickly as possible during current interruption, small gaps again are important. In some recent experiments, it has been shown that a 1,100 ampere arc, which is forced by its self-induced magnetic field to move between parallel arcing-rails travels fastest for the smallest gap. The velocity varies from ~ 6.3 inches/msec (~360 mph) for 0.04 inch gap, to ~3 inches/msec. (~170 mph) for a 0.2 inch gap.

The present invention incorporates both the advantages of the small contact separation with the advantages of rapid movement of the arc between parallel arcing-rails in order to make a very compact, and yet really effective low-voltage circuit-breaker.

Figure 1:
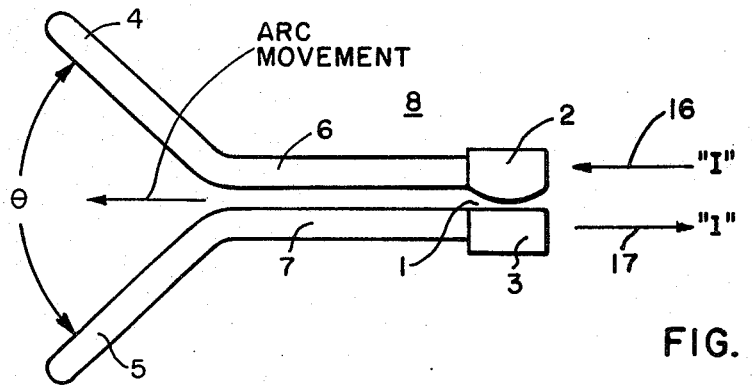
FIG. 1 is a somewhat diagrammatic view of a pair of separable contacts having connected thereto a pair of parallel-disposed arcing-rails having end diverging arc-horn portions, the view indicating the direction of the arc current and the magnetic thrust exerted upon the arc tending to affect its motion.

Typical examples of the present invention are shown in FIG. 1. Each of these variations illustrate the main principles of the design, which are: (a) A contact system with only a small gap in the open position, (b) a parallel-rail system with a small gap to move the arc rapidly away from the contact electrodes, (c) movement of the arc into a current-limiting system (in this case diverging arcing-rails).

The examples shown in FIG. 1, of course, by no means limit the possible arrangements that can be envisioned when incorporating these three major principles.

The electrode material, its size, its shape, how it should be operated, and the gap in the open-circuit position, and the design of the arcing-rails (cross-section, shape, composition and length) all have to be considered. As the contact electrodes part, the self-induced magnetic field forces the resulting arc off the contact surfaces, and forces it to run along the arcing-rails. The movement of the arc prevents excessive erosion of the contact surfaces, and the velocity of the arc while it runs on the arcing-rails is so great that here again the resulting erosion is low. The stretching of the arc with the diverging arcing-rails, and its eventual ending in metallic or insulating extinguishing plates, gives rise to an increase in arc voltage with a corresponding current limitation.

Care must be taken in the design of this device for high-current interruption, so that ionized plasma and ultraviolet radiation will be prevented from returning to the small gap region of the circuit-breaker.

Figure 5:
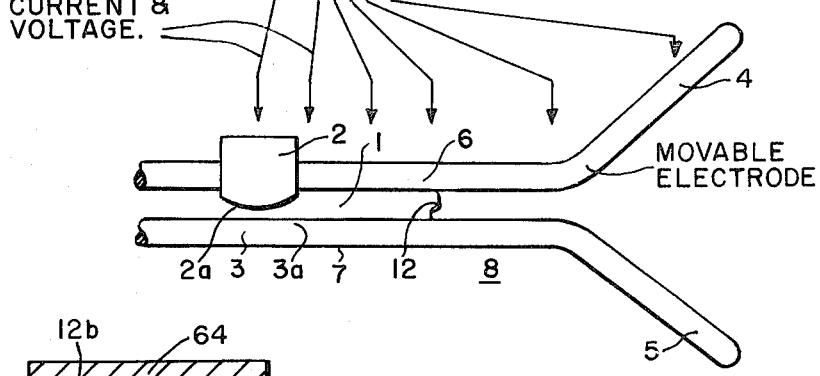
FIG. 5 illustrates the movable electrode and arcing-horn configuration of an experimental circuit-breaker, fully opened, and the arrows indicating the position of the arc and the corresponding current and voltage magnitudes, as set forth in the graph of FIG. 4.

An experimental circuit-breaker was built. Its design was similar to that shown in FIG. 1, and is illustrated in FIG. 5. In the fully-open position, the gap 1 (FIG. 1) between the contact electrodes 2, 3 was 0.1 inches. The angle $\theta$ of divergence of the rails 4, 5 was 70°. The movable electrode 2 was made from OHFC copper, machined to a ½ inch in diameter, and a contacting surface with a 1 inch radius. The rails 6, 7 were ¼ inch in diameter, and again were OHFC copper. The circuit-breaker 8 was operated using an experimental opening system. No attempt was made to optimize the performance of this device 8; the purpose of the experiment was to see how well the above principles worked in practice.

Figure 4:
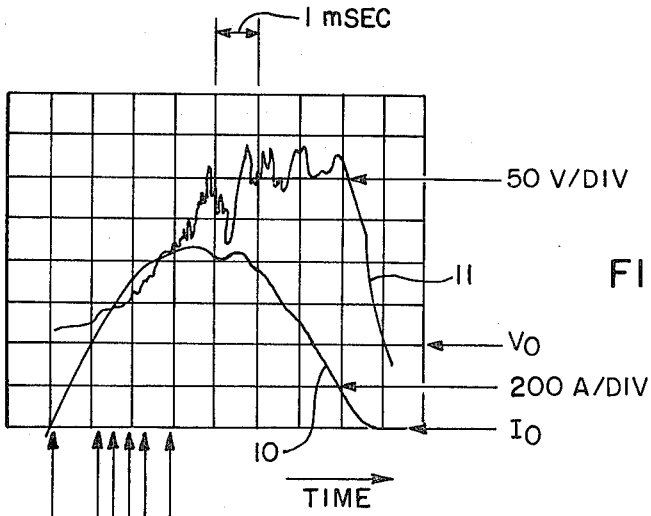
FIG. 4 is a graph of current and arc-voltage as a function of the elapsed time of arcing during an opening operation of a circuit-breaker having the electrode configuration of FIG. 5.

The result of interrupting a 1,100 ampere (peak) a.c. current in a 440 volt rms circuit is shown in FIG. 4. The current and voltage characteristics 10, 11 of the experimental breaker 8 compare very favorably with a 400 ampere metallic-plate breaker, operating under the same conditions. The peak current has been limited to ~880 amperes (a limiting of >20%) and this has been achieved without any optimization of the device 8. By placing probes in the path of the arc 12, (FIG. 5) it was possible to relate the position of the arc 12 to the current and voltage characteristics 10, 11 of FIG. 4. In this case, the arc 12 takes ~1 msec to move off the contacting surfaces.

By using a suitable choice of electrode material, contact opening mechanism and enhancement of the self-induced magnetic field in the contact region, this arc motion can be speeded up. The arc 12 travels at between 1.2 inches/msec and 1.6 inches/msec (the velocity being a function of the current, the gap, the contact opening velocity and the self-induced magnetic field). When the arc 12 moves onto the diverging arcing-rails 4, 5, the arc voltage increases very rapidly to 250 volts. One of the most striking features of this experiment was that very little electrode erosion was seen after many operations of the device 8.

This straightforward experiment shows that the principles embodied in this invention can produce an effective circuit-breaker 8 which combines the features of high-power interruption with low contact erosion.

Figure 2:
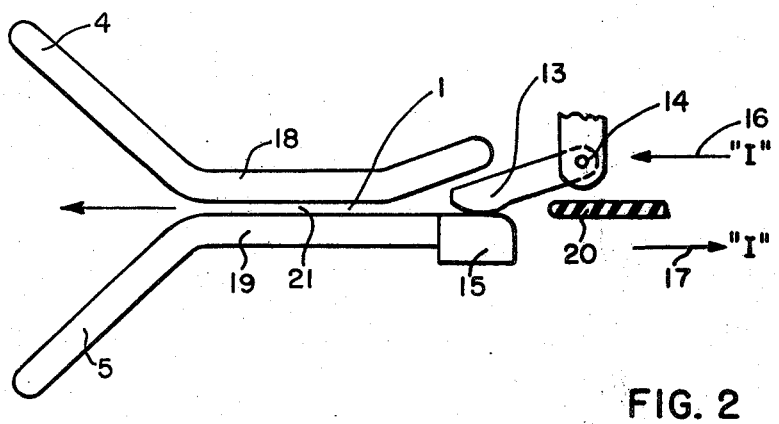
FIG. 2 is a view, somewhat similar to that of FIG. 1, but showing a different embodiment of the invention in which two stationary arcing-rails are utilized, to which the arc is transferred, again the view illustrating the direction of current flow and the direction of magnetic thrust exerted upon the established arc tending to effect its motion.

FIG. 2 illustrates a modification of the invention in which a movable electrode 13 is pivotally mounted at a stationary pivot 14, and cooperates with a relatively stationary contact 15. The current path is illustrated by the arrows 16 and 17. The two arcing-horns, or arcing-rails 18, 19 are fixed in position in the embodiment of the invention illustrated in FIG. 2, and means are provided, such as an insulating blade, or contact insulating splitter 20, being ultilized to effect clockwise opening rotative motion of the pivotally-mounted movable electrode, or contact 13 during the opening operation.

From an inspection of FIG. 2, it will be apparent that when the movable electrode 13 rotates about its fixed pivot 14, an arc will be established, and will be magnetically moved in a leftward direction between the spaced fixed arcing-horns 18, 19. It will be noted that again there is only a relatively short distance 21 between the fixed arcing-horns 18, 19 of the embodiment of the invention, as set forth in FIG. 2.

Figure 3:
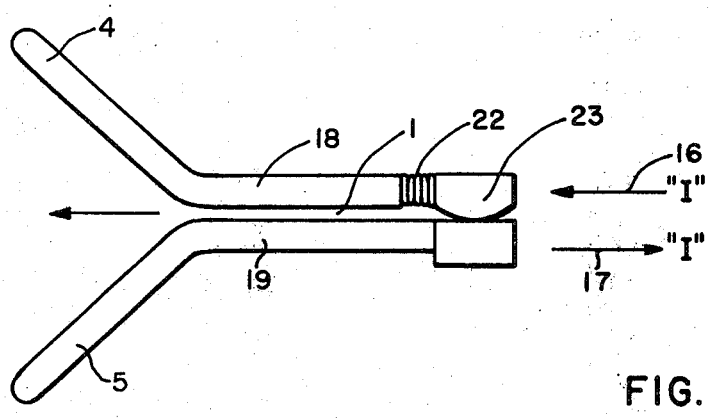
FIG. 3 illustrates still another embodiment of the invention in which a pair of fixed arcing-rails, or arcing-horns are provided, somewhat similar to those of FIG. 2, but a different movable-contact construction being illustrated, having a flexible connection connecting the movable contact, or electrode to the upper stationary arcing-horn.

FIG. 3 shows an alternate form of the invention in which a flexible connection 22 is interposed between the upper fixed arcing-horn 18 and the movable contact, or electrode 23. Again, the current path is indicated by the arrows 16 and 17. In this embodiment of the invention, as set forth in FIG. 3, upward movement of the movable electrode 23 will establish an arc, which again will be transferred toward the left upon the fixed arcing-horns, or arcing-rails 18, 19, and will be magnetically moved toward the left and upon the end terminal portions of the arcing-rails 4 and 5, as before.

Figure 6:
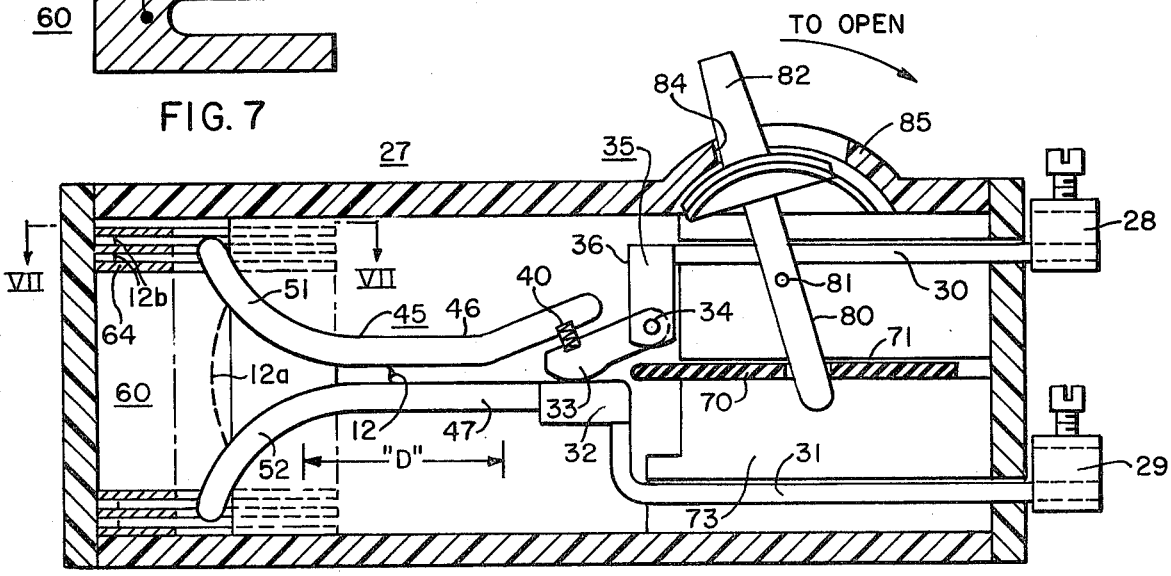
FIG. 6 illustrates a commercial-type of circuit-breaker utilizing the principles of the present invention, the separable contacts being illustrated in the closed-circuit position, and an arc-extinguisher being utilized.

FIG. 6 illustrates another embodiment 27 of the invention, generally showing a commercial form thereof, in which a pair of line terminals 28 and 29 are provided connected by conducting straps 30 and 31 to a stationary contact 32 and to a pivotally-arranged movable contact 33, the latter being stationarily pivoted at 34. As shown, the stationary pivot 34 for the rotatable movable contact 33 is provided by a generally L-shaped member 35 having one leg portion 30 connected to the line terminal 28 and having the other leg portion 36 connected, as by brazing, to the conducting strap-support portion 30.

Suitable biasing means, such as a compression spring 40, for example, may be provided to bias the rotatable movable contact 33 into good contacting engagement with the stationary contact 32. Disposed in close proximity to the separable contacts 32 and 33 is a parallel-rail system 45 comprising a pair of generally-parallel-disposed stationary arcing-rails, or arcing-horns 46, 47, which extend for quite a distance D in generally-parallel relationship, as illustrated in FIG. 6 of the drawings.

Figure 7:
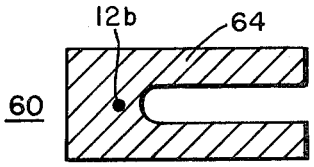
FIG. 7 is a sectional view taken along the line VII—VII of FIG. 6.

At the lefthand ends of the arcing-rails 46 and 47 are continuous diverging portions 51, 52 causing an elongation of the established arc 12, as indicated by the dotted lines **12*a*. Adjoining the lefthand diverging portions of the arcing-rails 51, 52 is a surrounding generally U-shaped plate structure 60, illustrated more clearly in FIG. 7, whereby the established arc 12, 12*a* is split up into a plurality of serially-related arc-portions 12*b*. The cold metallic plates 64, together with the subdivision of the arc into many arc-portions 12*b***, quickly brings about arc extinction.

To effect an opening of the pivotally-mounted movable contact 33 there is provided, by way of example only, an insulating contact splitter 70, which is guided in horizontal slots 71, constituting a part of the side-wall structure 73 of the circuit-breaker 27, which guide-slots 71 serve as guides for the side edges of the contact-actuator 70. To effect leftward opening movement of the insulating splitter, or contact actuator 70, an operating lever 80, stationarily pivoted, as at 81, is actuated, for example, by a manually-operable handle 82, which extends through a slot 84 provided at the upper cover portion 85 of the circuit-breaker 27.

Thus, clockwise rotation of the manually-operable handle 82 about its stationary pivot 81 will effect corresponding leftward contact-separating motion of the insulating arc-splitter 70, thereby establishing the arc 12 and causing the latter to move in a leftward direction along the stationary-spaced arcing-rails 46, 47. As the arc 12 reaches the lefthand ends of the arcing-rails 46 and 47, it moves out upon the diverging arc-portions 51 and 52 and into the spaced metallic arc-extinguisher 60, becoming subdivided, as at 12*b*, and is thereby quickly extinguished.

Preferably, the distance between the generally-parallel-disposed arcing-rails 46, 47 is quite small, say of the order of ¼ inch, or less. This has the desirable advantage that the self-induced magnetic field is thereby accentuated, and causes rapid movement of the arc 12 in a lateral leftward direction outwardly upon the arcing-rails 46, 47. The invention has particular applicablilty to relatively low-voltage circuit-breakers having a voltage rating, say, for example, of the order of 1,000 volts rms or less, and a 100 ampere current rating. This rating is given only by way of example, and, of course, the principles of the present invention could be applied to other low-voltage circuit-breakers of ratings of magnitude comparable to the aforesaid rating.

Figure 9:
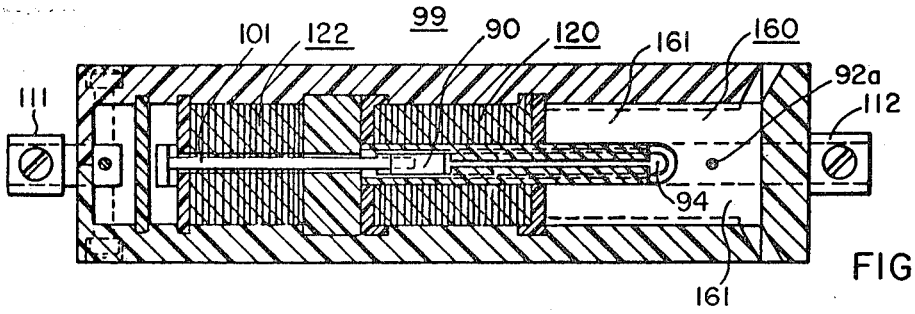
FIG. 9 is a sectional view taken substantially along the line IX—IX of FIG. 8.
Figure 8:
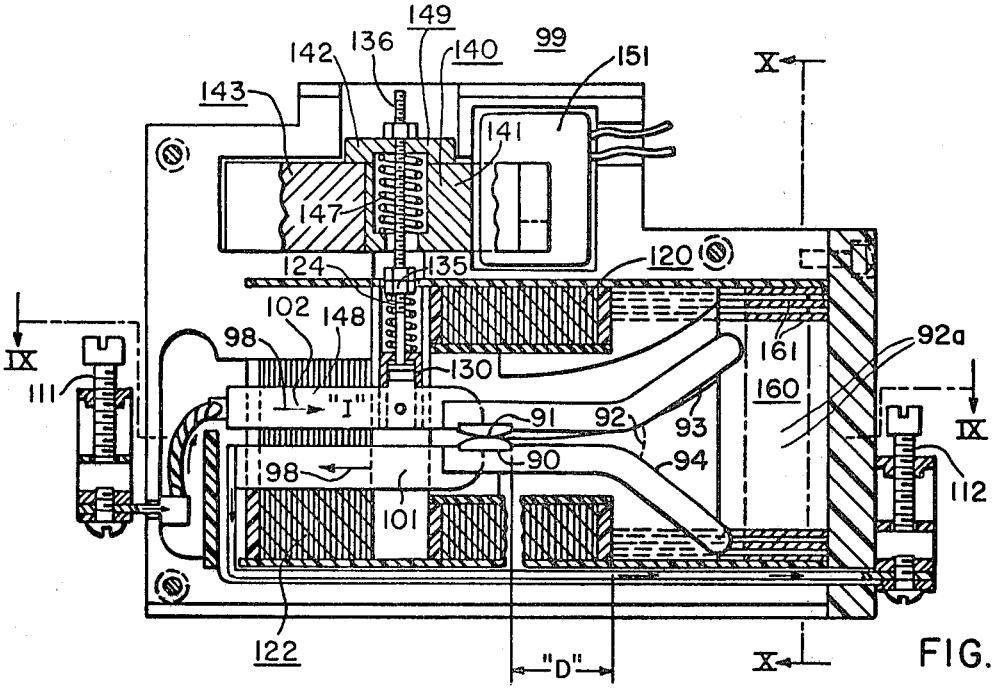
FIG. 8 is a vertical sectional view taken through a commercial-type of circuit-breaker construction utilizing the principles of the present invention, and the contact structure being illustrated in the closed-circuit position.
Figure 10:
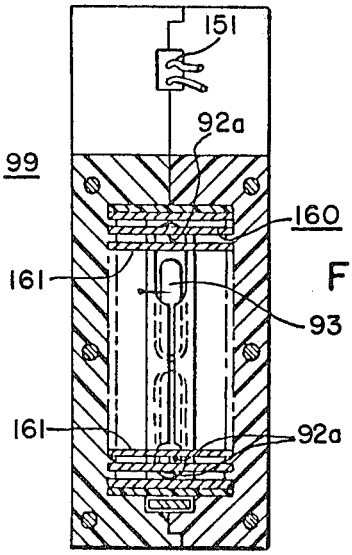
FIG. 10 is a vertical sectional view taken substantially along the line X—X of FIG. 8; and, FIG. 11 illustrates the arcing condition of the breaker of FIG. 8.

FIGS. 8–10 illustrate a commercial form of the invention embodying principles set forth hereinabove. In more detail, with particular reference being directed to FIG. 8 of the drawings, it will be observed that there is provided a relatively-stationary contact 90 cooperable with a relatively-movable contact 91 to establish an arc which is moved laterally along the arcing-rails or horns 93, 94, as more clearly illustrated in FIG. 11 of the drawings. It will be observed that there is a substantial longitudinal distance D for the arc 92 to move laterally, being impelled upon the arcing-rails 93, 94 by the self-induced magnetic field generated by the current I passing through the arcing-rails 93, 94 in opposite directions, as indicated by the dotted lines 98.

The established arc 92 is impelled laterally not only by the self-induced magnetic field generated by the current I passing through the stationary contact arm 101 and the movable contact arm 102, as heretofore described, but, additionally, a magnetic structure 120 is provided, which is termed herein a "magnetic gun". U.S. patent application filed Aug. 21, 1973, Ser. No. 390,283 by Paul Slade and John Wafer entitled "Improved Circuit-Breakers With Improved Magnetic Arc-Driving Systems" describes the functioning of the "magnetic gun" 120. The teachings and disclosures set forth in said patent application, Ser. No. 390,283 are incorporated herein by reference.

In addition to the magnetic gun 120, utilized in the construction of FIGS. 8–11, there is moreover provided a "magnetic-slot motor" 122, the principles of which are set forth in a companion U.S. patent application filed May 14, 1975, Ser. No. 577,518 by Paul Slade and John Wafer, entitled "The Curent Limiting Rail Circuit Breaker", and assigned to the assignee of the instant application. Here again, the disclosure and teachings set forth in said patent application Ser. No. 577,518 are incorporated herein by reference.

In the closed-circuit position of the circuit-breaker structure 99, as illustrated in FIGS. 8–11, the contact structure is maintained in the closed-circuit position by a compression spring 124, interposed between a bifurcated contact-actuator 130 and adjustable nuts 135, threadedly secured to a stud portion 136 of the operating assembly 140. A permanent magnet 141 is utilized to maintain a movable magnetic keeper 142 in position against the pole-faces of a magnet system 143, the principles of which are set forth in said patent applicaton Ser. No. 577,518.

An opening accelerating spring 147 is utilized tending to effect the opening of the movable contact arm 148 and the movable contact 91, but the latching system 149 retains the movable contact structure in the closed-circuit position by virtue of the magnetic keeper 142 being magnetically latched and held into place.

A pair of flux-transfer trip coils 151 are utilized, which may be energized, and effect a flux transfer in the magnetic system 143 to thereby release the magnetic force imposed upon the movable magnetic keeper 142 and permit the opening accelerating spring 147*a* to effect upward opening motion of the movable contact arm 148 together with its affixed movable contact 91. Reference may be made to the detailed description, set forth in said patent application Ser. No. 577,518, for a detailed description of the magnetic effects, and the releasing action of the magnetic system 143 thereby to enable the compression spring 147 to open the circuit-breaker 99. Such a detailed description appears to be unrelated to the invention set forth herein and, if desired, reference may be made to said patent application for such a description. The important thing to notice is that once an opening operation is effected by release of the magnet system 143, and the opening action exerted by the compression spring 147, the contacts 90, 91, upon separation, will establish the arc 90, which will move laterally toward the right, as set forth in FIG. 11, and the magnetic action and motion of which has been described above in connection with the other embodiments of the invention.

It wll be noted that the aforesaid releasing action of the magnetic system 143 may be accomplished by energizing the flux-transfer coils 151 at the will of the operator. Upon the existence of fault currents, or overload currents above a predetermined amperage magnitude, however, the "slot motor" system 122 will take over, and will cause the exertion of very large upward force imposed upon the movable contact arm 148 to thereby overcome the magnetic action exerted upon the movable magnetic keeper 142 and will supersede the latching effect caused thereby, and result in a rapid opening motion similar to that which is described above with the manual opening operation accomplished by energizing the flux-transfer coils 151.

Thus, it will be apparent that there are two methods of opening the circuit-breaker 99: the first method utilizing the energization of the flux-transfer coils 151 to magnetically release the movable magnetic keeper 142, and thereby permit the opening accelerating spring 147 to take over to cause an opening operation of the breaker. This may, of course, occur at relatively low current magnitudes, or at any time at the will of the operator.

Figure 11:
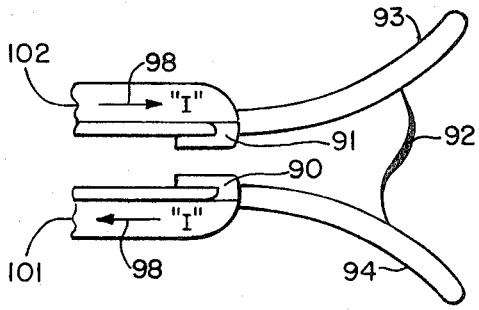

The other method of opening the circuit-breaker 99 is caused by the existence of excessive fault currents passing through the breaker 99 above a certain amperage level which will bring into existence the magnetic forces caused by the "slot motor" effect 122, and will effect upward contact separation by causing an upward force, which is greater than the downward force imposed by the movable magnetic keeper 142. Opening will occur as heretofore described, and the arc 92 will be moved laterally, as illustrated in FIG. 11, by the self-induced magnetic affects, as heretofore described in the other embodiments of the invention.

FIG. 8 illustrates the utilization of an arc-extinguishing structure 160 comprising a plurality of spaced metallic plates 161, which will cause a subdivision of the established arc 92 into a plurality of serially-related arc-portions 92*a*, which will become cooled by the cool surfaces of the metallic plates and will become extinguished.

Although the continuous current capacity for the circuit-breaker of FIGS. 8–10 is 100A, a device of this type was found to be capable of interrupting potential fault currents up to 100kA in a low voltage circuit (600V or less). This is set forth in said patent application Ser. No. 577,518.

From the foregoing description, it will be apparent that there has been described an improved low-voltage circuit breaker 8, 27 in which an effort is made to provide small contact spacing 1, and an arrangement of laterally-disposed parallel arcing-rails, or arc horns, 6, 7 and 46, 47, of generally parallel spaced-apart relationship, having only a small gap distance therebetween, of the order of ¼ inch, or less, and preferably said arcing-rails 46, 47 having diverging end portions 51, 52 which diverge rapidly to result in rapid increased arc elongation, and consequently an increase in the arc voltage.

The advantages of my invention are:

1. Small gaps mean a reduction in size, a corresponding reduction in cost and an increased profitability.
2. Small movement of the electrode implies a reduction in size of the operating mechanism.
3. The parallel arcing-rails cause the arc to move away from the contacting surface very rapidly, thus reducing contact erosion and also improving interrupting ability.
4. By reducing the contact erosion, smaller electrodes will be required which would save silver.
5. With proper design these principles could be used for both a.c. and d.c. low-voltage, high-current circuitbreaker devices.

Although there have been illustrated and described specific interrupting structures, it is to be clearly understood that the same were merely for the purpose of illustration, and that changes and modifications may readily be made therein by those skilled in the art, without departing from the spirit and scope of the invention.

I claim:

1. A low-voltage air-type circuit-breaker adaptable for quickly interrupting low-voltage electrical circuits of the order of 1000 volts or less, the combination comprising, means defining a pair of separable contacts, means for separating said pair of separable contacts only a relatively short distance apart of the order of ¼ inch, or less, a pair of adjoining conducting arcing-rails to which the established arc may be laterally transferred from said pair of separable contacts, said pair of conducting arcing-rails being in generally parallel relationship, and in the open-circuit position being only one-fourth inch apart, or less, and the self-induced magnetic field resulting from the current-flow rapidly moving the established arc laterally outwardly upon the closely-spaced arcing-rails to facilitate its extinction.

2. The combination of claim 1, wherein the ends of said conducting arcing-rails diverge to cause a further elongation of the established arc.

3. The combination according to claim 1, wherein one of the conducting arcing-rails is attached to the movable contact and moves therewith during the opening operation.

4. The combination according to claim 1, wherein the movable contact is pivotally mounted, and is caused to open by the imposition of a laterally-movable insulating member.

5. The combination according to claim 1, wherein a flexible connector interconnects the movable contact with one of the adjoining conducting arcing-rails.

6. The combination according to claim 1, wherein an arc-extinguishing structure is disposed adjacent the ends of the arcing-rails.

7. The combination according to claim 2, wherein an arc-extinguishing structure is disposed adjacent the diverging portions of the spaced arcing-rails.

8. The combination according to claim 4, wherein said insulating member is actuated by a pivotally-mounted operating handle having one end thereof projecting externally of the casing structure for the circuit-breaker.

* * * * *